US005819967A

United States Patent [19]

Lo

[11] Patent Number: 5,819,967

[45] Date of Patent: Oct. 13, 1998

[54] CHILD-RESISTANT, SENIOR FRIENDLY CONTAINER

[75] Inventor: Julian B. Lo, Old Lyme, Conn.

[73] Assignee: Pfizer Inc., New York, N.Y.

[21] Appl. No.: 868,384

[22] Filed: Jun. 3, 1997

Related U.S. Application Data

[60] Provisional application No. 60/019,593 Jun. 12, 1996.

[51] Int. Cl.[6] ..... B65D 50/10

[52] U.S. Cl. ..... 215/206; 215/216; 215/221

[58] Field of Search ..... 215/204, 206, 215/208, 209, 216, 217, 218, 219, 221, 223, 274, 330

[56] References Cited

U.S. PATENT DOCUMENTS

| | | | |
|---|---|---|---|
| 3,572,532 | 3/1971 | Shannon . | |
| 3,913,769 | 10/1975 | Scrocco et al. | 215/216 X |
| 3,917,097 | 11/1975 | Uhlig | 215/216 |
| 4,006,836 | 2/1977 | Micallef | 215/218 |
| 4,144,983 | 3/1979 | Pauls et al. | 215/216 |
| 4,399,921 | 8/1983 | Kusz . | |
| 4,427,124 | 1/1984 | Marshall et al. | 215/216 |
| 4,782,963 | 11/1988 | Hunter . | |
| 4,865,209 | 9/1989 | Bush . | |
| 4,948,002 | 8/1990 | Thorncock et al. | 215/216 X |
| 4,991,729 | 2/1991 | Hunter . | |
| 5,027,954 | 7/1991 | Hickerson . | |
| 5,058,754 | 10/1991 | Hickerson . | |
| 5,184,739 | 2/1993 | Kusz . | |
| 5,224,615 | 7/1993 | Hickerson . | |
| 5,544,768 | 8/1996 | Gargione | 215/216 X |
| 5,735,417 | 4/1998 | Darr et al. | 215/216 |

*Primary Examiner*—Allan N. Shoap
*Assistant Examiner*—Nathan Newhouse
*Attorney, Agent, or Firm*—Peter C. Richardson; Gregg C. Benson; Carl J. Goddard

[57] ABSTRACT

A child-resistant, elderly-accessible safety container designed for storage of potentially hazardous materials. The closure includes three major components: a rotatable member secured coaxially around the neck of the container and having at least one biasing member disposed along its upper surface, at least one resilient abutment member, extending outward from the neck and terminating in a tip end, and is capable of being distended or compressed by the biasing member, and a closure member having at least one closure member stop disposed along its inner surface. Turning the rotatable member in a predetermined direction causes the biasing member to contact and compress the abutment member tangentially in relation to the outer surface of the neck. Such compression interrupts contact of the tip end of the abutment member with the closure member stop allowing the closure member to be rotated in the opposite direction and removed from the container. Alternatively, turning the rotatable member in another predetermined direction causes the biasing member to contact and distend the abutment member tangentially in relation to the outer surface of the neck. Such distension reinforces contact of the tip end of the abutment member with the closure member stop and prevents the closure member from being rotated in the opposite direction and removed from the container.

12 Claims, 5 Drawing Sheets

CHILD-RESISTANT, SENIOR FRIENDLY CONTAINER

RELATED APPLICATION

This application is filed claiming priority from co-pending Provisional application Ser. No. 60/019,593, filed Jun. 12, 1996.

BACKGROUND OF THE INVENTION

The current "push-and-turn" and "squeeze-and-turn" types of child-resistant closures are designed to be manipulated by normal adults. Because both designs require a certain amount of physical strength and coordination involving two hands for opening they are generally considered to be child-resistant. Examples of such safety closures may be found, inter alia, in U.S. Pat. No's. 3,880,313; 4,134,513; 4,180,174; 4,383,618; 4,413,743; 4,598,833; 5,147,053; 5,184,739, the disclosures of which are incorporated herein by reference. In those instances, however, the torsional exertion necessary for cap rotation or the compressional forces required for partial deformation of the cap and/or container may pose a considerable challenge for the elderly or patients suffering from arthritis or other disease states which affect the articulating surfaces of the joints. Alternatively, so-called "turn-then-turn" mechanisms are also known where locking rings or similar features are incorporated into the safety closure design. Here, a discreet series of turns, often in non-instinctive directions, is required to remove the cap from the container. Examples of such closures may be found, inter alia, in U.S. Patent No's. 3,572,532; 3,850,325; 4,006,836; 4,399,921; and 4,865,209, the disclosures of which are incorporated herein by reference. While many elderly patients possess the requisite cognitive abilities necessary to understand these motions, they still may not have the manual dexterity required for successful manipulation of the mechanism. Recently, more sophisticated examples of this type of mechanism have been disclosed, inter alia, in U.S. Pat. No's. 5,027,954; 5,058,754; 5,224,615 and 4,782,963 and 4,991,729, the disclosures of which are also incorporated herein by reference. All of these designs, however, are complicated mechanically and require many manufacturing steps during assembly as well as the added expense of producing the specialized component parts related thereto.

SUMMARY OF THE INVENTION

This invention provides an improved safety closure mechanism for containers used in storing hazardous or potentially harmful materials, such as pharmaceuticals, caustic or corrosive agents, toxins, and the like.

This invention also provides containers having a safety closure mechanism which is of simple and relatively inexpensive construction yet may be employed to good effect in preventing unauthorized access by children or persons of a mentally-incompetent nature.

Further still, this invention provides containers having a safety mechanism which may be manipulated easily by the elderly or others having severely diminished or impaired digital ability, such as patients suffering from arthritis. In keeping with this objective, the operation of the mechanism of the instant invention may be performed using a single hand.

REFERENCE NUMERALS IN THE DRAWINGS

Figure 1:
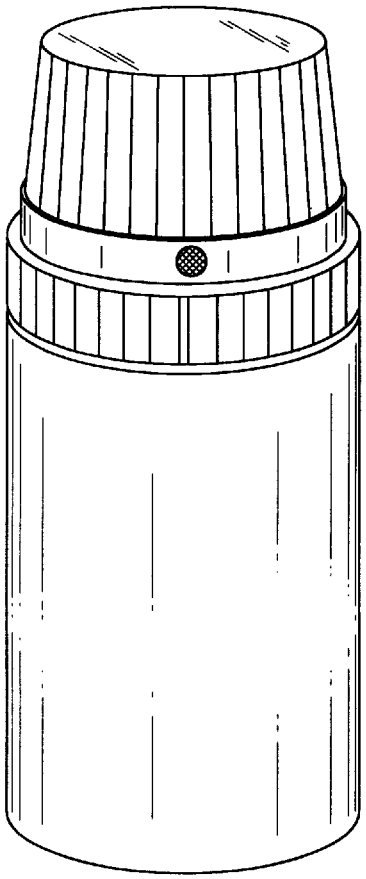
FIG. 1 depicts a conventional, cylindrically-shaped container with the safety closure mechanism disposed thereon.

1 container
2 shoulder
3 neck
4 closure member
5 fastening means
6 closure member stop
7 closure member stop sidewall
8 abutment member
9 abutment member tip end
10 rotatable member
11 biasing member
12 alignment marker

DETAILED DESCRIPTION OF THE INVENTION

Figure 2:
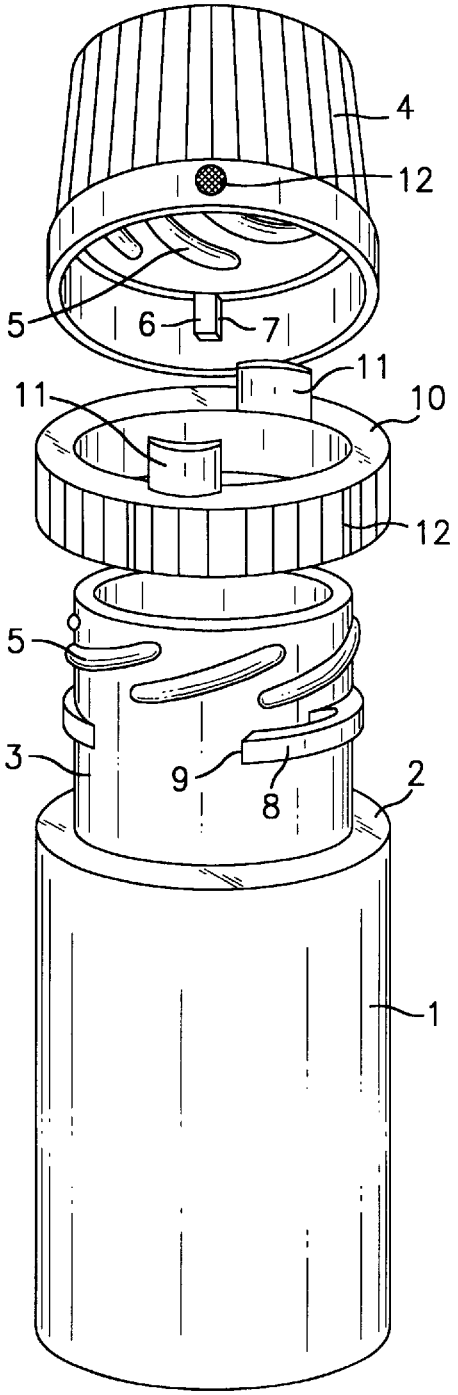
FIG. 2 is a fragmentary perspective of the container and the component parts of the instant invention in relation thereto.
Figure 5:
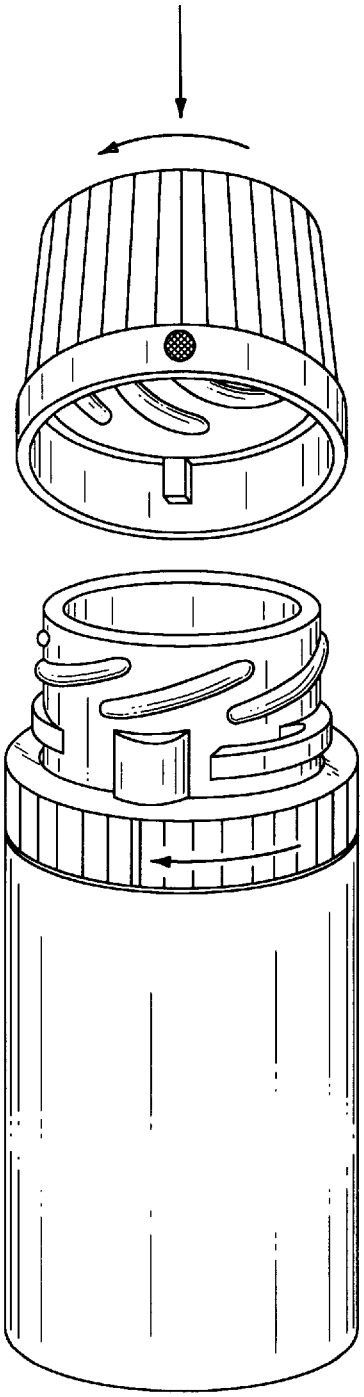
Figure 5A:
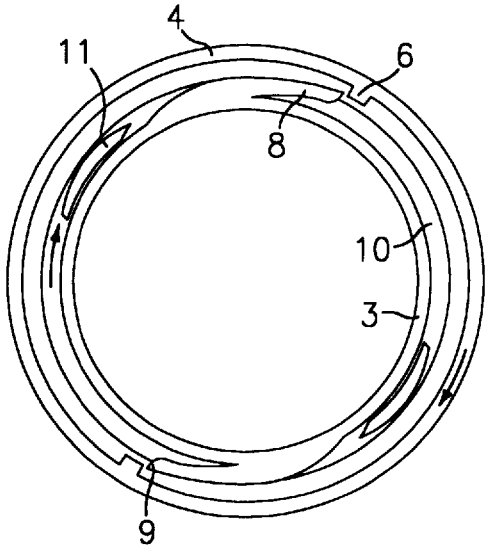
Figure 6:
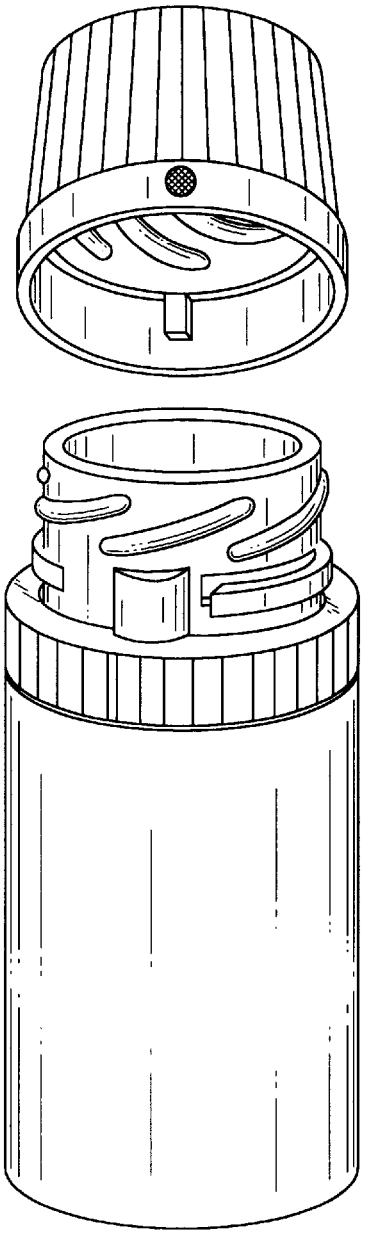
FIG. 6 and 7 show alternate embodiments of the invention.
Figure 7:
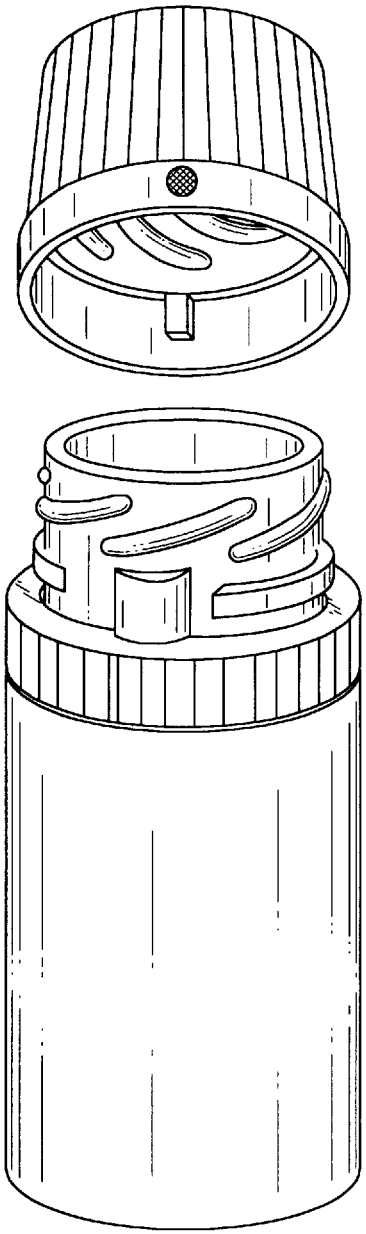

The safety closure of the instant invention is mounted on, or constructed integrally with, a conventional container 1 having a neck 3. The container may be formed from plastic or similar material which is physically and/or chemically compatible with the material which it is designed to hold. The closure member 4, generically known as a cap, is used to seal the container 1. The container 1 and closure member 4 are designed to be secured together using conventional, rotatably engaging fastening means 5, such as screw-threaded segments disposed, for example, on the neck 3 and the inner surface of the closure member 4. Additionally, the closure member 4 has at least one closure member stop 6 along the inner surface and preferably below the fastening means 5. While the closure member stop 6 of the instant invention may comprise a detent formed into the inner surface of the closure member 4 or an opening extending completely through the closure member, it is preferred that at least one pair of diametrically opposed projections extending slightly from the inner surface of the closure member 4 comprise the closure member stop feature of the instant invention. Each closure member stop 6 has an exposed sidewall 7. The neck 3 is fitted with at least one elongated abutment member 8, extending outward from the surface of the neck 3 and terminating in a tip end 9. It is preferred that at least one pair of diametrically opposed projections located below the fastening means 5 comprise the elongated abutment member feature of the instant invention. Although FIG. 6 shows the abutment member 8 as an excised or "cutout" segment of the neck 3, the abutment member 8 may also be formed integrally with the neck, i.e. comprise a separate component attached to the neck 3, as shown in FIG. 7. The abutment member 8 is physically resilient in nature and is able to be distended and compressed tangentially in relation to the outer surface of the neck 3. Normally, when not in a compressed state relative to the outer surface of the neck 3, the abutment member 8 is distended almost completely and the tip end 9 is in contact with the exposed sidewall 7 of the closure member stop 6 as shown in FIG. 5*a*. The steps of distension and compression of the abutment member 8 are effected through manipulation of the rotatable member 10 which is disposed coaxially about the neck 3 and between the closure member and the container 1. Although FIG. 2 depicts a cylindrically-shaped container having a shoulder 2 for supporting the rotatable member 10, it is to be understood specifically that the objectives of the instant invention may be met in conjunction with containers of any shape or size and that the rotatable member 10 may be mounted on the neck of the container by any conventional method, for example being engaged in a suitable frictional arrangement with the neck, secured to the neck in a groove or collar adapted to receive the rotatable member or any similar arrangement. The rotatable member 10 may be of any manually manipulable shape, such as an oval, square, ring, and the like, but it is generally preferred, for ease of manipulation, that the rotatable member 10 be in the form of a ring having a diameter slightly greater than that of both the closure member 4 and neck 3 of the container 1 to which it is attached. It is also preferred that the rotatable member 10 have a patterned outer surface to facilitate gripping by hand during manipulation. A serrated pattern is preferred. The rotatable member 10 has at least one biasing member 11 disposed thereon which extends upward between the inner surface of the closure member 4 and the outer surface of the neck 3. When turned, the rotatable member 10 urges the biasing member 11 to operatively contact and either distend or compress the abutment member 8 relative to the outer surface of the neck 3. Distention of the abutment member 8 by the biasing member enforces contact of the tip end 9 with the closure member stop sidewall 7 while compression of the abutment member 8 disengages the tip end 9 from contact with the closure member stop sidewall 7. It is preferred that at least one pair of diametrically opposed projections, disposed on the upper surface of the rotatable member, comprise the biasing member feature of the instant invention. In normal operation of the instant invention, the abutment member 8, because of its resilient nature, is capable of independently contacting, at the tip end 9, an exposed sidewall 7 of the closure member stop 6, thereby blocking rotation, and subsequent removal of the closure member 4 from the container. However, for purposes of a reinforced lock of the mechanism, it is preferred that the biasing member 11 distend the abutment member 8 completely outward with respect to the inner surface of the closure member 4, thus enforcing rigid contact of the tip end 9 with the exposed sidewall 7 of the closure member stop 6.

Figure 3:
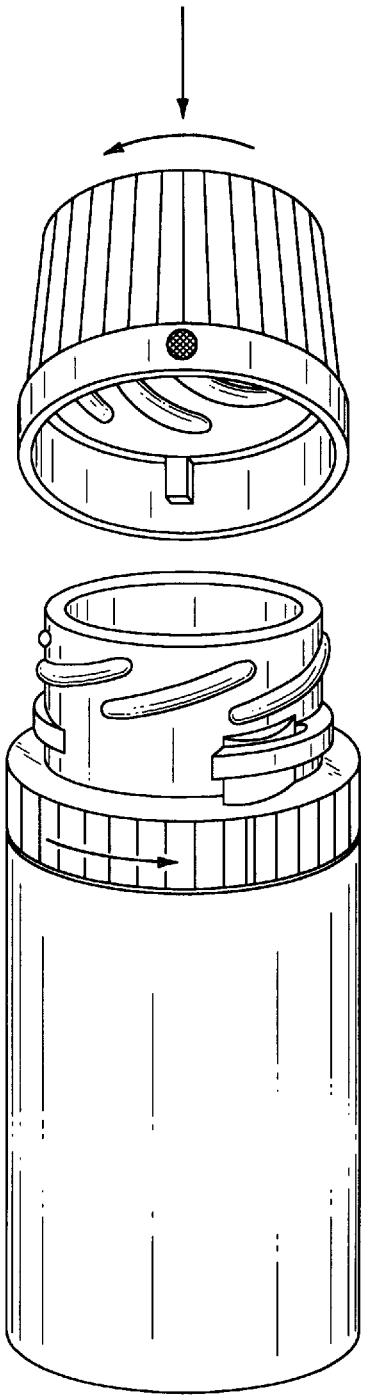
FIGS. 3 through 5*a* illustrate the interaction of the component parts of the invention including the steps used in manipulating the mechanism thereof.
Figure 3A:
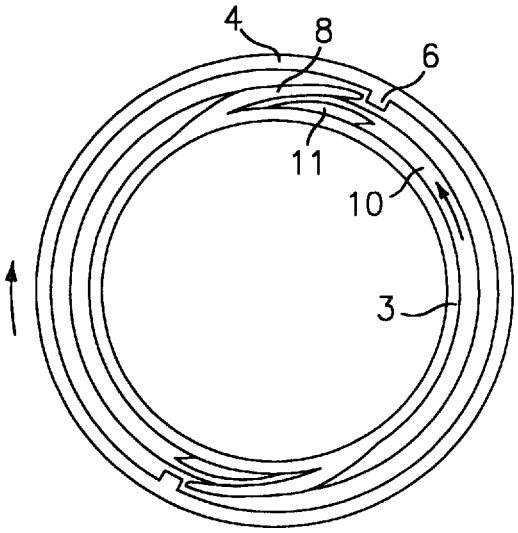
Figure 4:
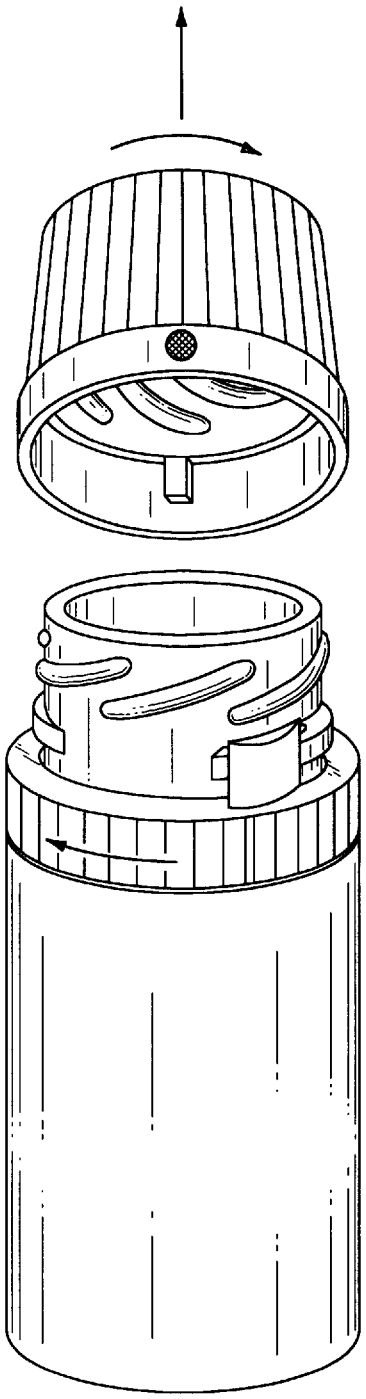
Figure 4A:
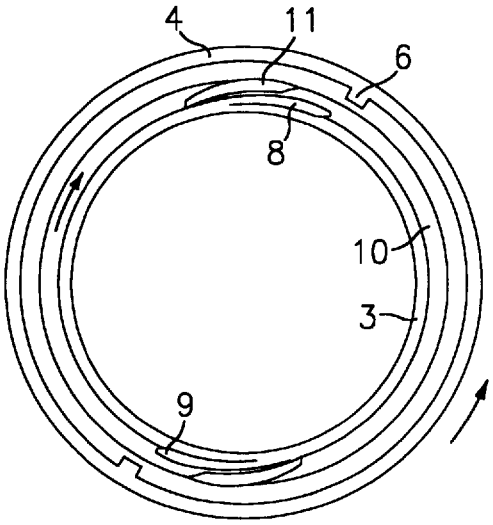

To remove the closure member from the locked container shown in FIG. 1, the rotatable member 10 is first turned in a predetermined direction, i.e. clockwise as shown in FIGS. 4 and 4*a*. The biasing member 11 compresses the abutment member 8 inward in relation to the outer surface of the neck 3 and forces the tip end 9 out of contact with the exposed sidewall 7 of the closure member stop 6. The closure member 4 may then be turned in the opposite, i.e. counterclockwise direction and removed from the container 1. Alternatively, the method used to secure the container is shown in FIGS. 5 and 5*a*. The closure member 4 is first placed back on the container 1 and rotated in a predetermined direction, i.e. clockwise until seated fully. The rotatable member 10 is then turned slowly clockwise until the biasing member 11 releases the abutment member 8 from its compressed position in relation to the outer surface of the neck 3. It is preferred that the resiliency of the abutment member 8 be such that, upon release from the biasing member 11, the abutment member impacts the inner surface of the closure member 4 thereby providing an audible indication to the user that full release of the abutment member 8 from the biasing member 11 has been achieved. Optionally, if desired, the abutment member 8 may also be released from its compressed position by the counterclockwise rotation of the rotatable member 10. For confident operation of the mechanism, however, it is preferred that an audible signal, indicating release of the abutment member 8 from the biasing member 11, be discerned. Any attempt to now rotate the closure member 4 in a direction to allow its removal from the container 1, i.e. counterclockwise, will cause the exposed sidewall 7 of the closure member 4 to contact the tip end 9 of the abutment member 8 thus blocking further rotation of the closure member 4. While the apparatus is considered secure at this point, it is preferred that the mechanism be placed in a fully locked condition using the procedure depicted in FIGS. 3 and 3*a*. The rotatable member 10 may now be turned further counterclockwise causing the biasing member 11 to contact and distend the abutment member 8 further outward in relation to the outer surface of the neck 3. At this point, the tip end 9 of the abutment member comes into locked contact with the exposed sidewall 7 of the closure member stop 6, thus firmly blocking the rotation, and subsequent removal of, the closure member 4 from the container 1. In a preferred embodiment of the instant invention, the closure member 4 and the rotatable member 10 have alignment markers 12 placed thereon. These alignment markers permit the user to correctly ascertain and align the relative positions of the abutment member 8 and the closure member stop 6 with respect to the rotatable member 10 and the closure member 4 without necessitating visual observation of the working mechanism which, for security reasons, is normally concealed under the closure member 4. It is preferred that the alignment markers comprise cooperatively disposed, colored projections which are capable of tactual or visual discernment.

It will be appreciated by those skilled in the art that, while the instant invention has been described hereinabove with respect to several preferred embodiments, other variations and modifications may also be made thereto without departing from the scope and spirit of the invention.

I claim:

1. An apparatus comprising:

a container having a neck terminating at an open end portion wherein said neck has an outer surface and fastening means disposed on said outer surface;

a closure member for sealing said container which comprises a cap having an inner surface and fastening means disposed about said inner surface wherein said fastening means rotatably engage with said fastening means on said neck;

at least one closure member stop disposed on said inner surface of said cap wherein said closure member stop has an exposed sidewall;

at least one resilient abutment member extending outward from said outer surface of said neck and terminating in a tip end wherein said abutment member is distendible and compressible tangentially in relation to said outer surface of said neck;

a rotatable member disposed coaxially about said neck wherein said rotatable member has an upper surface and an outer surface; and at least one biasing member disposed on said upper surface of said rotatable member and extending upward between said inner surface of said cap and said outer surface of said neck wherein rotation of said rotatable member in one direction allows said biasing member to operatively contact and distend said abutment member tangentially in relation to said neck so that said tip end of said abutment member contacts said sidewall of said closure member stop so that rotation of said cap in the opposite direction is prevented and, rotation of said rotatable member in one direction allows said biasing member to operatively contact and compress said abutment member so that contact of said tip end of said abutment member with said sidewall of said closure member stop is interrupted thereby permitting rotation of said cap in the opposite direction and removal thereof from said container.

2. An apparatus as claimed in claim 1 wherein said rotatable member has a diameter slightly greater than said container neck and said cap.

3. An apparatus as claimed in claim 1 wherein said rotatable member has a patterned outer surface.

4. An apparatus as claimed in claim 1 wherein said rotatable member is a ring.

5. An apparatus as claimed in claim 1 wherein said closure member stop comprises at least one pair of diametrically-opposed projections.

6. An apparatus as claimed in claim 1 wherein said biasing member comprises at least one pair of diametrically-opposed projections.

7. An apparatus as claimed in claim 1 wherein said abutment member is formed integrally with said neck.

8. An apparatus as claimed in claim 1 wherein said abutment member is an excised segment of said neck.

9. An apparatus as claimed in claim 1 wherein said closure member and said rotatable member have at least one alignment marker disposed thereon.

10. An apparatus comprising:

a container having a neck terminating at an open end portion wherein said neck has an outer surface and fastening means disposed on said outer surface;

a closure member for sealing said container which comprises a cap having an inner surface and fastening means disposed about said inner surface wherein said fastening means rotatably engage with said fastening means on said neck and said closure member has at least one alignment marker disposed thereon;

one pair of diametrically-opposed closure member stops disposed on said inner surface of said cap wherein said closure member stops each have an exposed sidewall;

one pair of diametrically-opposed, resilient abutment members extending outward from said outer surface of said neck and each terminating in a tip end wherein said abutment members are distendible and compressible tangentially in relation to said outer surface of said neck;

a rotatable member disposed coaxially about said neck wherein said rotatable member has an upper surface and a patterned outer surface, a diameter slightly greater than said neck and said closure member, and at least one alignment marker disposed thereon; and one pair of diametrically-opposed biasing members disposed on said upper surface of said rotatable member and extending upward between said inner surface of said cap and said outer surface of said neck wherein rotation of said rotatable member in one direction allows said biasing members to operatively contact and distend said abutment members tangentially in relation to said neck so that said tip ends of said abutment members contact said sidewalls of said closure member stops so that rotation of said cap in the opposite direction is prevented and, rotation of said rotatable member in one direction allows said biasing members to operatively contact and compress said abutment members so that contact of said tip ends of said abutment members with said sidewalls of said closure member stops is interrupted thereby permitting rotation of said cap in the opposite direction and removal thereof from said container.

11. An apparatus as claimed in claim 10 wherein said abutment members are formed integrally with said neck.

12. An apparatus as claimed in claim 10 wherein said abutment members are excised segments of said neck.

* * * * *